US005619313A

United States Patent [19]

Domoto et al.

[11] Patent Number: 5,619,313

[45] Date of Patent: Apr. 8, 1997

[54] METHOD AND APPARATUS FOR LIQUID IMAGE DEVELOPMENT AND TRANSFER

[75] Inventors: Gerald A. Domoto, Briarcliff Manor; John F. Knapp, Fairport; Vittorio Castelli, Yorktown Heights; Joannes N. M. deJong, Suffern; Lloyd A. Williams, Mahopac, all of N.Y.

[73] Assignee: Xerox Corporation, Stamford, Conn.

[21] Appl. No.: 431,803

[22] Filed: May 1, 1995

[51] Int. Cl.[6] ..... G03G 15/10; G03G 15/14

[52] U.S. Cl. ..... 399/233; 399/302

[58] Field of Search ..... 118/659, 660, 118/661, 662; 355/256, 257, 258, 268, 271, 272, 274, 277, 326 R, 327, 245

[56] References Cited

U.S. PATENT DOCUMENTS

| | | | |
|---|---|---|---|
| 4,498,758 | 2/1985 | Nelen | 355/271 |
| 4,707,112 | 11/1987 | Hartmann . | |
| 4,912,514 | 3/1990 | Mitzutani | 355/272 |
| 4,935,788 | 6/1990 | Fantuzzo et al. | 355/326 |
| 5,012,289 | 4/1991 | Aldrich et al. | 118/661 X |
| 5,028,964 | 7/1991 | Landa et al. | 355/273 |
| 5,285,244 | 2/1994 | Bujese | 355/256 |
| 5,355,201 | 10/1994 | Hwang | 355/256 |
| 5,387,760 | 2/1995 | Miyazawa et al. | 118/661 |

*Primary Examiner*—Sandra L. Brase
*Attorney, Agent, or Firm*—Tallam Nguti

[57] ABSTRACT

A method and apparatus for simultaneously developing and transferring a liquid toner image. The method includes the steps of moving a photoreceptor including a charge bearing surface having a first electrical potential, applying a uniform layer of charge having a second electrical potential onto the charge bearing surface, and imagewise dissipating charge from selected portions on the charge bearing surface to form a latent image electrostatically, such that the charge-dissipated portions of the charge bearing surface have the first electrical potential of the charge bearing surface. The method also includes the steps of moving an intermediate transfer member biased to a third electrical potential that lies between said first and said second potentials, into a nip forming relationship with the moving imaging member to form a process nip. The method further includes the step of introducing charged liquid toner, having a fourth electrical potential, into the process nip, such that liquid toner sandwiched within the nip simultaneously develops image portions of the latent image onto the intermediate transfer member, and background portions of the latent image onto the charge bearing surface of the photoreceptor.

32 Claims, 6 Drawing Sheets

METHOD AND APPARATUS FOR LIQUID IMAGE DEVELOPMENT AND TRANSFER

BACKGROUND OF THE INVENTION

This invention relates to electrostatographic printing machines, and more particularly to a method and apparatus for simultaneously developing and transferring a liquid toner image onto an intermediate transfer member for subsequent conditioning thereon.

A typical electrostatographic printing machine employs a photoconductive member that is sensitized by charging to a substantially uniform potential. The charged portion of the photoconductive member is exposed to the light image of a document. Exposure of the charged photoconductive member selectively dissipates the charge to record an electrostatic latent image. The electrostatic latent image corresponds to the informational areas of the document. The electrostatic latent image recorded on the photoconductive member is developed by contact with a developer material. The developer material can be a dry material comprising carrier granules having adhering toner particles. The latent image attracts the toner particles from the carrier granules to form a toner powder image on the photoconductive surface. The toner powder image is then transferred and permanently fused to a copy sheet.

An electrostatic latent image also may be developed with a liquid developer material. In a liquid development system, the photoconductive surface is contacted with an insulating liquid carrier having dispersed finely divided marking particles. The electrical field associated with the electrostatic latent image attracts the marking particles to the photoconductive surface to form a visible image.

Liquid developing imaging processes utilize a liquid developer typically having about 2 percent by weight of fine solid particulate toner material dispersed in a liquid carrier. The liquid carrier is typically a hydrocarbon. In the developing process, the image is transferred to a receiver which may be an intermediate belt. The image on the photoreceptor contains about 12 weight percent of particulate toner in liquid hydrocarbon carrier. To improve the quality of transfer of developed image to receiver, percent solids in liquid should be increased to about 25 percent by weight. Increase in percent solids may be achieved by removing excess hydrocarbon liquid. However, excess hydrocarbon liquid must be removed in a manner that results in minimum degradation of the toner image.

Prior art liquid ink development systems operate such that the photoconductor surface rotates through the developer bath to make contact with the toner. In these systems, the toner particles are attracted to the latent electrostatic image on the photoconductor surface. The motion of the toner particles in the imagewise electric field is generally called electrophoresis and is well known in the art. However, the liquid carrier also wets the photoconductor surface. It is very difficult to transfer the toner image to paper without either first removing the liquid carrier from the photoconductor surface or using the liquid carrier to enable transfer to the paper and subsequently removing the liquid carrier from the paper. In both cases, the liquid carrier must be removed by processes that must include evaporation of the liquid carrier into the air, which causes airborne pollution.

U.S. Pat. No. 4,707,112, to Hartmann, Nov. 17, 1987, relates to an apparatus for developing an electrostatic latent image. The apparatus includes means for furnishing liquid developer material to the image in a development zone and means for dispersing the particles substantially uniformly in the liquid carrier of the liquid developer material at the entrance to the development zone so as to deflocculate marking particles. The dispersing means may comprise means for generating a pulsed electrical field in the developer material at the entrance to the development zone to induce movement of the marking particles and the liquid carrier. The generating means includes an electrode positioned at the entrance to the development zone and means for applying a pulsed voltage to the electrode to generate a pulsed electrical field in the developer material.

SUMMARY OF THE INVENTION

In accordance with one aspect of the present invention, there is provided an apparatus for simultaneously developing and transferring a liquid toner image. The apparatus includes a movable photoreceptor including a charge bearing surface having a first, uncharged electrical potential. The apparatus also includes mechanisms for forming a latent image electrostatically on the charge bearing surface such that the latent image includes charged areas each having a second electrical potential, and discharged areas each having the first, uncharged electrical potential of the charge bearing surface. The apparatus also includes a movable intermediate transfer member that forms a process nip with the charge bearing surface, and is biased to a third electrical potential between the first and the second potentials. The first, second and third electrical potentials are such as to create an electrical field within the process nip. The apparatus further includes a device for introducing charged liquid toner having a fourth electrical potential into the process nip such that the charged liquid toner is sandwiched within the electrical field in the process nip, and is caused by the electrical field to simultaneously form a toner image of image areas of the latent image on the intermediate transfer member, and a toner pattern of background areas of the latent image on the charge bearing surface of the photoreceptor.

Pursuant to another aspect of the present invention, there is provided a method for simultaneously developing and transferring a liquid toner image. The method includes the steps of moving a photoreceptor including a charge bearing surface having a first electrical potential, applying a uniform layer of charge having a second electrical potential onto the charge bearing surface, and imagewise dissipating charge from selected portions on the charge bearing surface to form a latent image electrostatically, such that the charge-dissipated portions of the charge bearing surface have the first electrical potential. The method also includes the steps of moving an intermediate transfer member biased to a third electrical potential between the first and second potentials, into a nip forming relationship with the moving imaging member to form a process nip. The method further includes the step of introducing charged liquid toner having a forth potential, into the process nip, and sandwiching a layer of the charged liquid toner within the process nip, such that the sandwiched liquid toner simultaneously develops image portions of the latent image onto the intermediate transfer member, and background portions of the latent image on the charge bearing surface of the photoreceptor.

Other features of the present invention will become apparent from the following drawings and description.

BRIEF DESCRIPTION OF THE DRAWINGS

In the detailed description of the invention presented below, reference is made to the drawings, in which.

DETAILED DESCRIPTION OF THE INVENTION

While the present invention will be described in connection with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
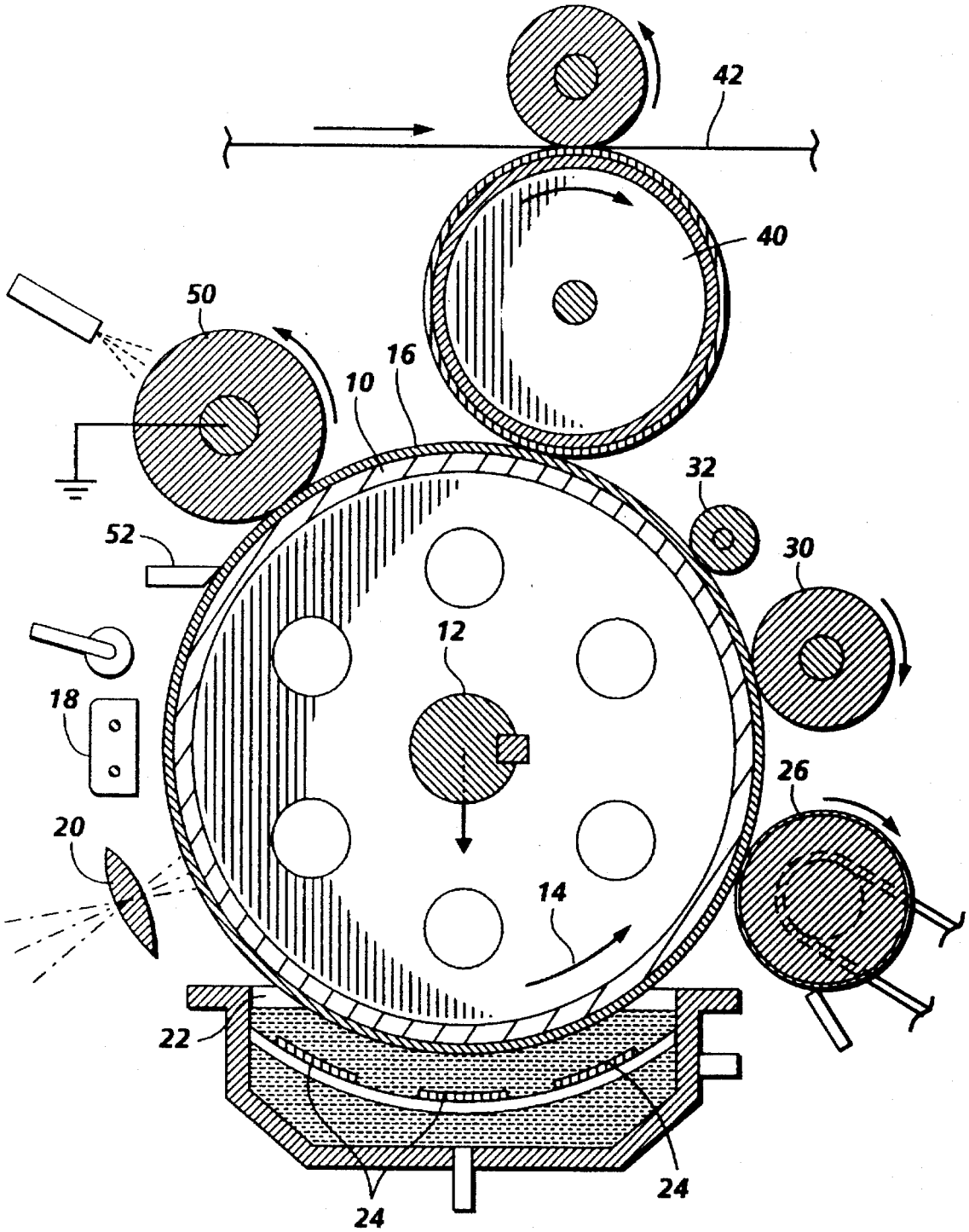
FIG. 1 PRIOR ART
FIG. 1 is a prior art simplified sectional illustration of a conventional liquid development electrophotographic apparatus.

Referring first to FIG. 1, a prior art example of a conventional electrophotographic liquid development apparatus is illustrated and includes a drum 10. The drum 10 is rotatable about an axle 12 in the direction of arrow 14. Drum 10 includes a photoconductive surface 16 on which a uniform layer of charge, for example, positive charge, is applied by a corona device 18. As is well known, the charged surface 16 is imagewise exposed by exposure means including a lens 20 to form a latent image on the surface 16.

Continued rotation of the drum 10 brings the latent image into a development relationship with a liquid developer apparatus 22 that holds liquid developer. The apparatus 22 includes development electrodes 24 for creating a desired electrical field for latent image development. Following such development, a rotating roller 26 operates to meter and partially reduces the amount of liquid in the developed liquid developer image now on surface 16. Next, a rigidizing roller 30 is used to compress and rigidize the liquid developer forming the developed image, and a squeegee roller 32 is used to remove excess liquid from the developed image prior to image transfer.

An intermediate transfer member 40 is then provided for receiving the rigidized liquid image from the surface 16 for subsequent transfer to a receiving image substrate 42, such as a copy sheet of paper. Following transfer of the image from surface 16, it is cleaned by a roller 50 and wiper blade 52 to ready for using in forming another image.

Figure 2:
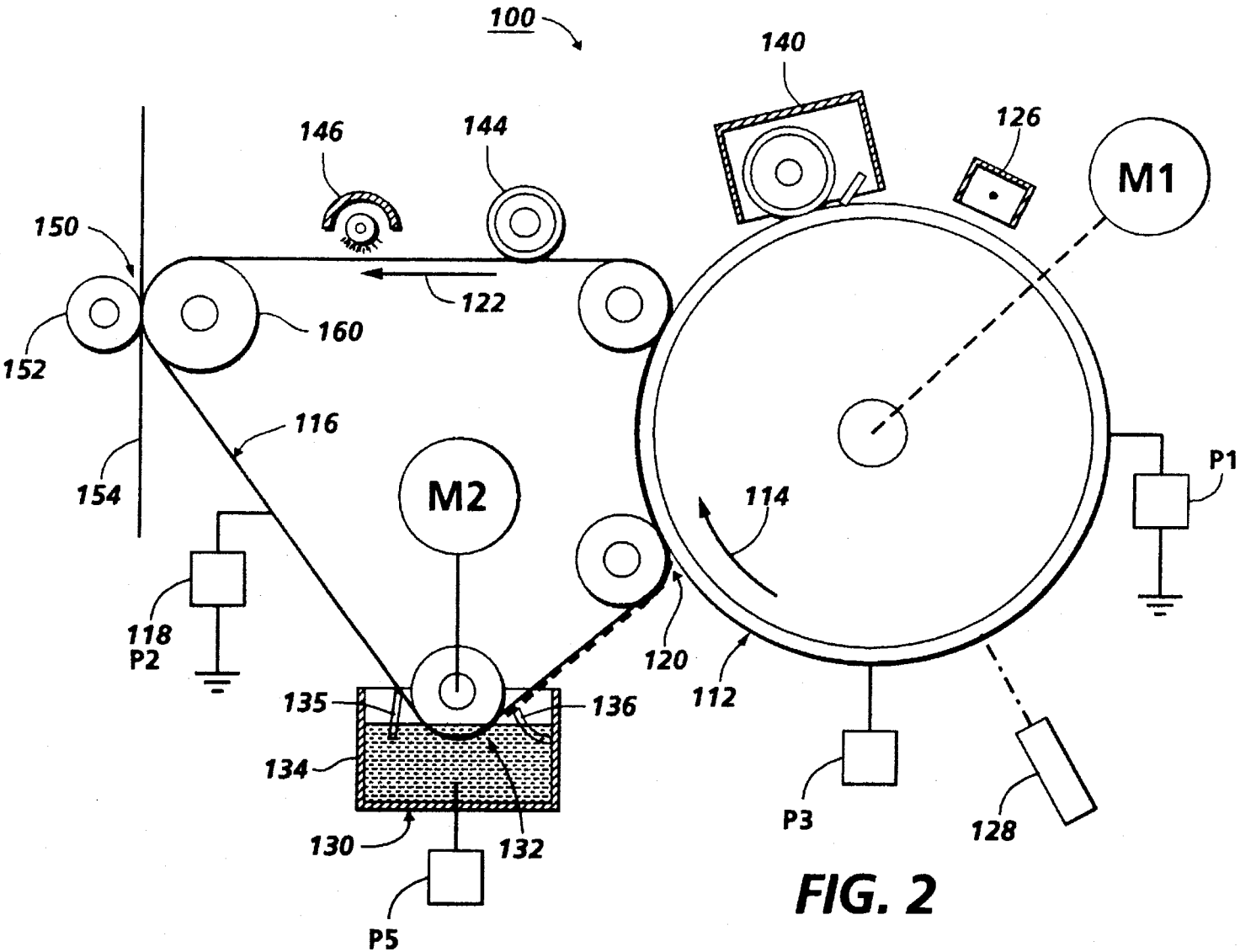
FIG. 2 is a schematic illustration of one embodiment of a liquid electrophotographic simultaneous development and transfer apparatus according to the present invention.

Referring now to FIG. 2, a first embodiment of an apparatus 100 for simultaneously developing and transferring a liquid toner image according to the present invention is illustrated. The apparatus 100 includes a movable latent image bearing member 110 that has a charge bearing surface 112. The image bearing member 110 for example can be a drum rotatable about an axis in the direction of the arrow 114, as shown, by a first drive or moving means M1 and at a first velocity (V1). Equally, the latent image bearing member 110 can also be a continuous flexible belt that is trained over a series of rollers, and is movable in the same direction as shown. According to the present invention, the latent image bearing member 110 can be any suitable charge and image bearing member, even one suitable for ionographic latent image formation. In either case, the member 110 is maintained at an uncharged, first electrical potential shown as P1.

The apparatus 100 also includes a movable intermediate toner image receiving and transfer member 116 that is biased to a second electrical potential P2 shown for example as ground 118. Importantly according to the present invention, a portion of the intermediate member 116 is wrapped over a portion of the charge bearing surface 112 to form a long process nip 120 with the charge bearing surface 112 of member 110. The intermediate member 116 is electrically conductive, or it can be comprised of a dielectric substrate that has an electrically conductive overcoating. According to the present invention, at least the latent image bearing member 110 or the intermediate member 116 has to be flexible in order to produce the long wrap nip 120. Accordingly, the intermediate member 116 is shown as a flexible belt that is trained and held in controlled tension about a series of rollers R1, R2, R3 and R4 for example, and is movable in the direction of the arrow 122 by a second drive or moving means M2. As shown, it is important that within the process nip 120, the intermediate transfer member 116 is being moved by the second moving means M2 in the same direction as the charge bearing surface 112 of the member 110, and at a second velocity (V2). The second velocity (V2) preferably is equal to the first velocity (V1) in order to achieve synchronous movement of the charge bearing surface 112 and the intermediate member 116 through the process nip 120.

Preferably, the long wrap, process nip 120 has a radius of curvature, and the movable intermediate member 116 has and follows a concave path through the curvature of the nip, as shown. As such, latent image bearing and photoconductive surface 112 of the member 110 therefore has and follows a convex path as shown within the process nip 120.

In accordance with the present invention, the apparatus 100 also includes means for forming a latent image electrostatically on the charge bearing surface 112. The means for forming a latent image can be ionographic, or as shown, it can be electrostatic, and so includes (a) a corona generating device 126 for applying a uniform layer of charge having a desired third electrical potential P3, and a desired polarity, for example a negative polarity, onto the charge bearing surface 112 of member 110. The means for forming a latent image electrostatically also includes discharging means 128 for imagewise discharging portions of the uniformly charged surface 112 to form a desired latent image. The latent image is so formed such that it includes, for example, undischarged image areas (as in a CAD process) which each have the third electrical potential P3, and discharged background areas which each have the same electrical potential P1 as the uncharged member 110. The first, second and third electrical potentials P1, P2, and P3 are selected such that P2 the potential of the intermediate member 116 lies between P1 and P3 of the member 110, so as to combine with charged liquid toner (as will be described below) to create electrical fields within the process nip 120 for simultaneous development and transfer of liquid toner images according to the present invention.

Alternatively, the latent image can also be so formed such that it includes, for example, discharged image areas (as in a DAD process) which each have the same electrical potential P1 as the uncharged member 110, and undischarged background areas which each have the third electrical potential P3. As such, the imagewise discharged portions of the charge bearing surface 112 comprise the image areas of the latent image, and the imagewise undischarged portions of the charge bearing surface 112 comprise the background areas of the latent image.

Further in accordance with the present invention, the apparatus 100 includes means 130 for introducing charged liquid toner 132 into the process nip 120. As shown, for example, the means 130 includes a source 134 of charged liquid toner or ink which preferably has a solids content between 2%–25% by volume. In a CAD process, i.e. charged area development process, the charged liquid toner 132 has a potential P5 and a polarity that are relatively the same as those of the first, uncharged, electrical potential P1 of surface 112, and that are relatively opposite to those of the third, charged electrical potential P3 of surface 112.

The source 134 can be a liquid developer unit including a cleaning blade 135, and a metering blade 136. The means 130 also includes, according to the present invention, the intermediate member 116 which is moved through the liquid developer unit 134 to receive a uniform coated layer of liquid toner for transport through the process nip 120. Accordingly, the means 130 for introducing charged liquid toner into the process nip 120 includes means 134, 136 and 116 for applying a uniform coating of liquid toner onto the intermediate member 116, at a point upstream of the process nip 120, relative to movement of the intermediate member 116.

Figure 3:
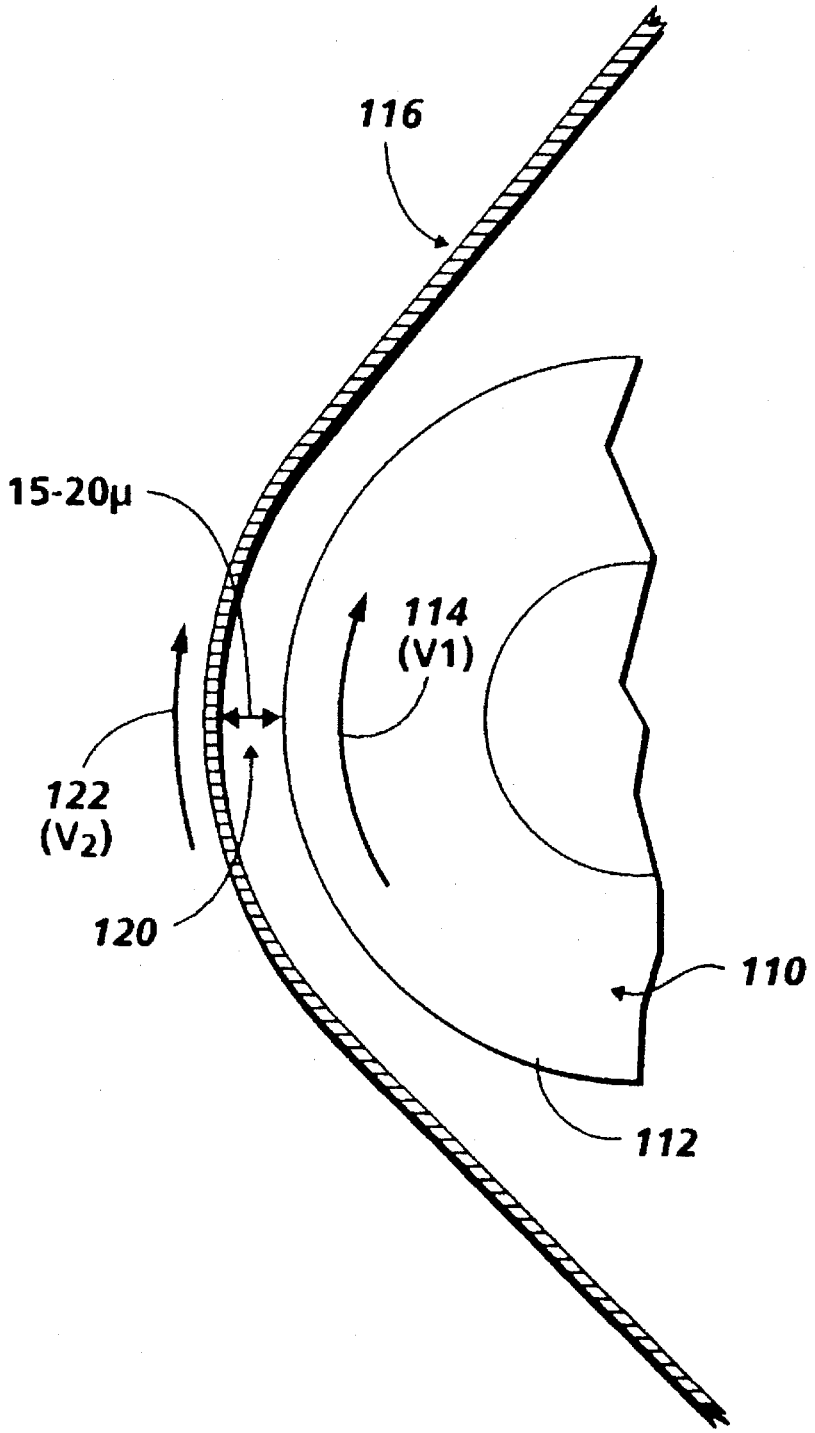
FIG. 3 is an enlarged schematic of a simultaneous development and transfer process nip of the apparatus of FIG. 2.
Figure 4:
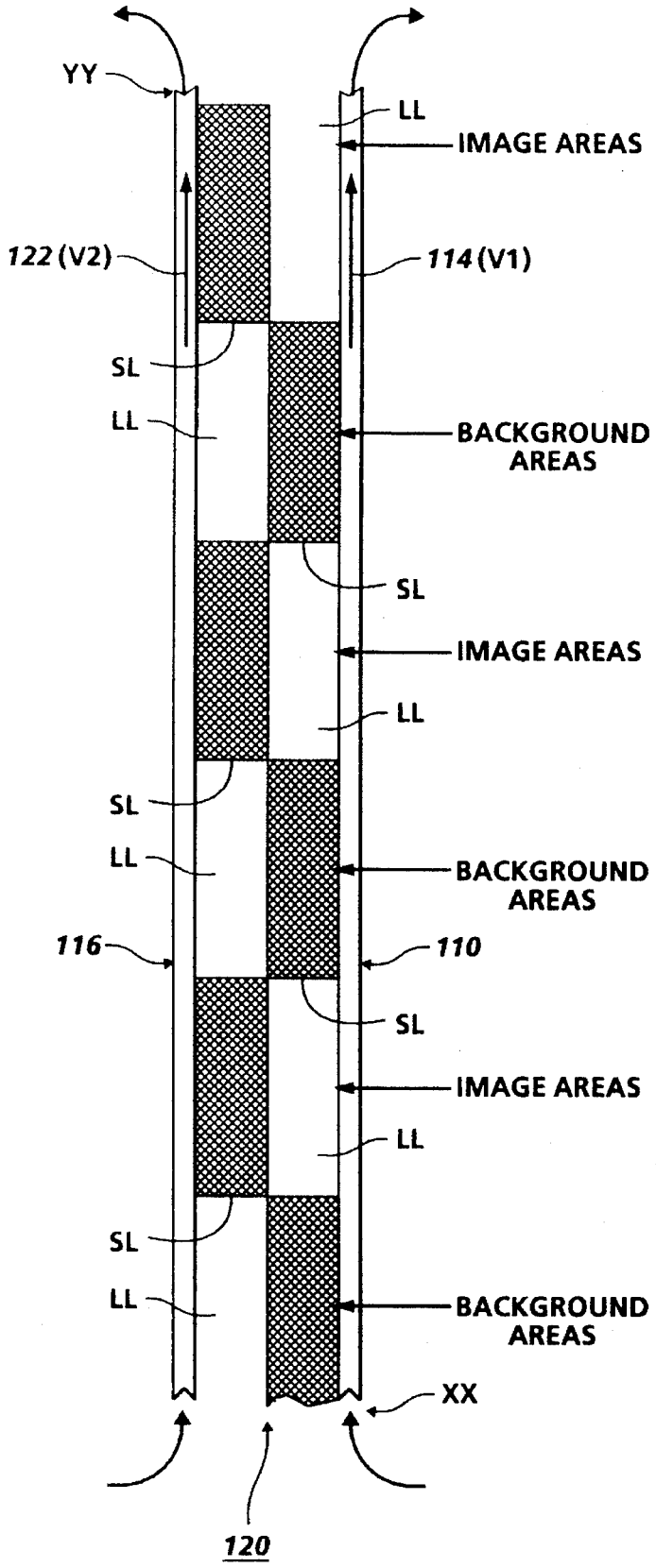
FIG. 4 is and enlarged illustration of the image portions versus background portions separation of sandwiched charged liquid toner in the process nip of FIG. 3.

Referring now to FIGS. 2–4, the layer of liquid toner brought into the nip 120 on the surface of intermediate member 116 is there sandwiched between the intermediate member 116 and the latent image bearing surface 112 as both move through the process nip 120, in the presence of electrical fields set up due to the various potentials P1 to P4 or P5. The simultaneous develop-and-transfer behavior of the sandwiched liquid toner within the process nip 120 will be described with particular reference to FIG. 4 in which P1 the uncharged potential of the surface 112 is +300v; P2 the potential of the intermediate member 116 is ground; P3 the charged potential of the surface 112 is −300v; and P5, the potential of the charged toner solids of the liquid toner, in a CAD process is −300v. Upstream of the nip 120, the intermediate member 116 which is biased at ground would appear opposite in polarity relative to the liquid toner solids at −300v. Therefore at the liquid toner applying stage, the liquid toner will be attracted to, and held onto, the intermediate member 116 for transport into the nip 120.

Within the nip 120, the undischarged image areas of the latent image with a potential of −300v will clearly be "like" in polarity and potential to the toner solids of the liquid toner, also at −300v. The behavior of the various components in these areas will be for the surface 112 to repel the toner solids towards the intermediate member 116, and the intermediate member 116 which is biased at P2, ground will tend additively to attract the same toner solids away from the repelling surface 112. As a result, toner solids representative of the image areas of the latent image will form and be held electrostatically on the intermediate member 116.

On the other hand, the discharged background areas of the latent image with a potential of +300v will be clearly opposite in polarity and potential to the toner solids of the liquid toner with a potential of −300v. The behavior of the various components in these background areas will clearly be opposite of what takes place in the undischarged image areas. For example, the surface 112 will instead attract the toner solids in these background areas away from the intermediate member 116. As a result, toner solids representative of the background areas of the latent image will form and be held electrostatically onto the surface 112.

As illustrated in FIG. 4, the behavior within the nip 120 of the various components as described above, results in the sandwiched liquid toner being segmented into two types of portions, image area portions and background area portions. Each portion of the segmented portions as illustrated includes a first layer SL made up primarily of toner solids attracted as described above to either the intermediate member 116 or to the surface 112, and a separate second layer LL consisting mainly of clear carrier liquid left behind after the toner solids have been attracted as above.

Accordingly, segmented portions of liquid toner in the image areas of the latent image will each comprise a first layer SL of toner solids that is in contact with the intermediate member 116, and a separate second layer LL, mainly of clear carrier liquid that is in contact with the charge bearing surface 112. On the other hand, segmented portions of liquid toner in the background areas of the latent image will each comprise a separate second layer LL of mainly clear carrier liquid in contact with the intermediate member 116, and a first layer SL of toner solids in contact with charge bearing surface 112.

In the above process, rheological measurements have been made to confirm the fact that the viscosity of the liquid layer LL of each segmented portion of sandwiched liquid toner is by far less than that of the solids layer SL of the same segmented portion. The migration of attracted charged toner solids between the surface 112 and intermediate member 116 is essentially in a normal or perpendicular direction. Preferably, the intermediate member should be tensioned to control the normal gap spacing between the surface 112 and intermediate member 116 at between 15–20 microns. As a consequence liquid toners with high solids contents can be used since the solids will be caused as above to migrate to one surface leaving a low viscosity layer against an opposite surface. Additionally, high viscosity carrier fluids can be used with such high solid content liquid toners, since the migration of the solids therefrom will be only across a relatively short gap distance.

Referring still to FIGS. 2–4, it is noted that the process nip 120 has an entrance side and point XX, and exit side and point YY. As illustrated, the intermediate member 116 and the latent image bearing member 110 including the charge bearing surface 112, are mounted so as to be moving, at an entrance, point XX, of the process nip 120, in the same direction into the nip. However, they are mounted for separating movement, at the exit point YY, away from each other and in substantially opposed directions.

According to the present invention, the separating movement is such that upon separation of the surface 112 and the intermediate member 116 at the exit point YY, each of the segmented portions of sandwiched liquid toner (comprising a solids layer SL, and a liquid layer LL) will "split" at the liquid layer LL thereof from the surface contacting such liquid layer. As such, toner image areas with the liquid layers contacting the surface 112 will split at the surface 112 leaving essentially clear liquid on the surface 112 in such areas, while the toner solids layers SL thereof making up the desired toner image from the process will separate and remain on the intermediate member 116. This in effect has been achieved within the nip 120 in a simultaneous develop-and-transfer manner. On the other hand, the split of the solids and liquid layers in the background areas will quite the opposite to that in the image areas. As such, the splits will occur on the intermediate member 116, leaving essentially clear liquid thereon, while the toner solids layer thereof will remain on the surface 112 for subsequent removal.

In other words, the above process is such that the sandwiched liquid toner within the electrical fields in the nip 120, simultaneously forms and transfers a liquid toner pattern, corresponding to background areas of the latent image, on the charge bearing surface 112. At the same time, the sandwiched liquid toner within the electrical fields in the nip 120, also simultaneously forms and transfers a liquid toner pattern, corresponding to image areas of the latent image, on the intermediate member 116. The apparatus 100 therefore includes a cleaning device 140 that is mounted downstream of the exit point YY of the process nip 120 for cleaning and removing liquid toner solids from the charge bearing surface 112, in preparation for reuse. The liquid toner image developed and transferred on the intermediate member 116 remains electrostatically attached or tacked to the member 116 downstream of the exit point YY, relative to movement of the member 116.

In accordance to the present invention, the apparatus 100 therefore includes means such as a blotter roll 144, and a heat source 146, for conditioning the liquid toner image directly on the intermediate member 116. Conditioning the image on the intermediate member 116 as such is particularly advantageous since heat can be used on the member 116 without damaging the latent image bearing photoconductive member 110, and surface 112.

As further shown, the apparatus 100 includes a transfer nip 150 that is formed in part by the intermediate member 116 and a back up roller 152 for transferring the conditioned liquid toner image from the intermediate member 116 onto a receiving substrate, such as copy sheet 154. As illustrated, the transfer nip 150 may include a heating means 160 for simultaneously heating and fixing the transferred liquid toner image onto the copy sheet 154.

In accordance with an important aspect of the present invention, there has been provided a method for simultaneously developing and transferring a liquid toner image in a liquid toner apparatus 100. The method includes the steps of moving an imaging member 110 that is biased to a first potential and includes a charge bearing surface 112, applying a uniform layer of charge having a second electrical potential onto the charge bearing surface 112, and imagewise dissipating charge from selected portions on the charged surface in order to form a latent image electrostatically on such surface. The method also includes the steps of moving an intermediate member 116 biased to a third electrical potential to form a process nip 120 with the moving imaging member 110, introducing charged liquid toner having a forth potential into the process nip, and sandwiching a layer of the liquid toner within the process nip 120 and electrical fields due to the various potentials, such that the sandwiched liquid toner simultaneously develops the latent image and transfers the developed image onto the intermediate member 116.

Figure 5:
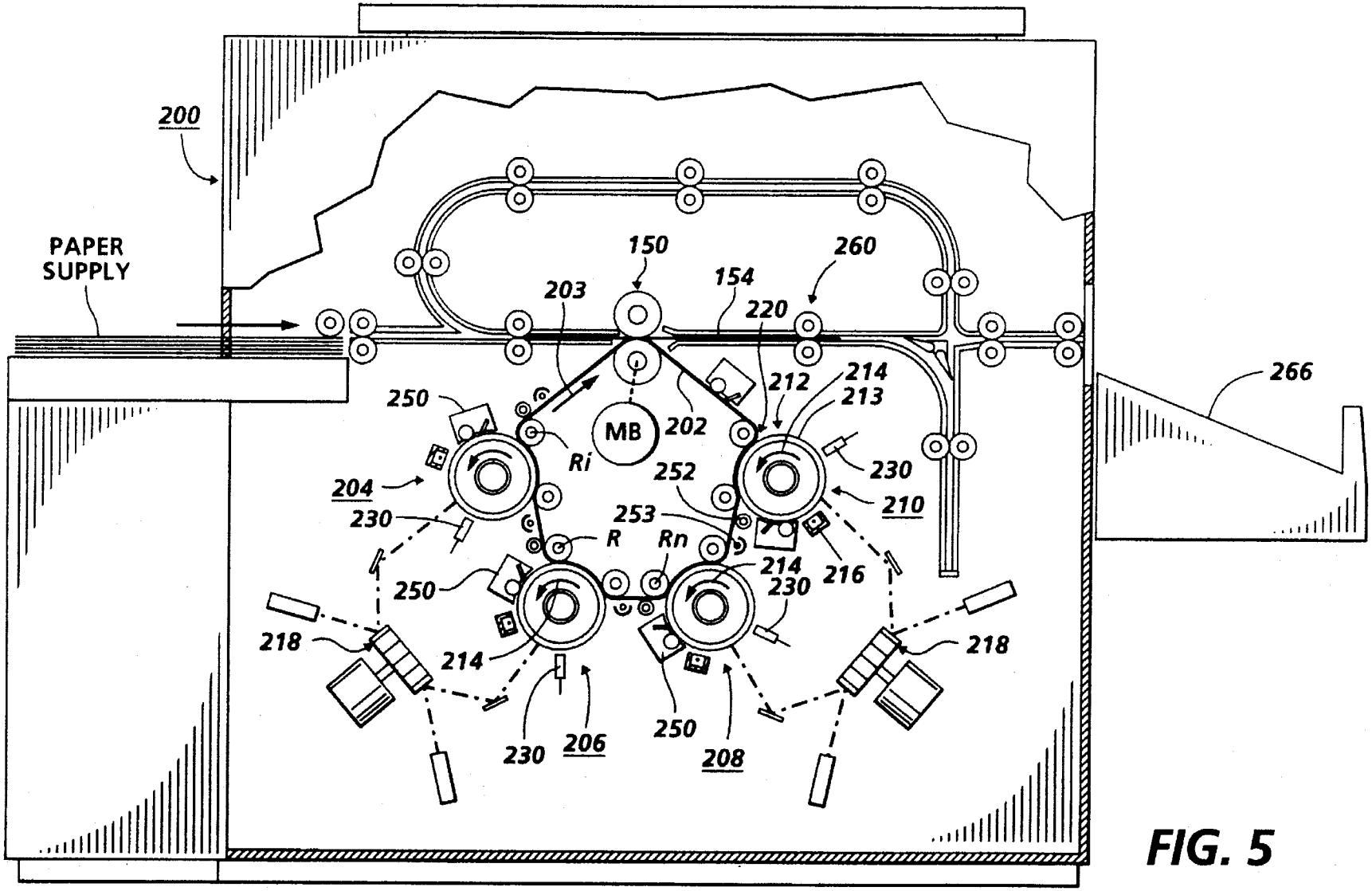
FIG. 5 is a schematic illustration of a multicolor embodiment of a liquid electrophotographic simultaneous development and transfer apparatus according to the present invention.

Referring now to FIG. 5 a multicolor embodiment of a liquid electrophotographic simultaneous development and transfer apparatus 200 according to the present invention is illustrated and includes a continuous transfer belt, designated generally by reference numeral 202. As shown, the transfer belt 202 is trained for movement about a series of rollers R1, R2, . . . Rn by a first drive such as MB. Continuous transfer belt 202 is moved as such in the direction of arrow 203, and is biased to a second electrical potential P2 according to the present invention. Four latent imaging units, indicated generally by the reference numerals 204, 206, 208 and 210, are positioned about the periphery of continuous transfer belt 202. Each latent imaging unit is substantially identical to one another. The only distinctions between the latent imaging units is their geometric position and the color of the liquid developer material employed therein. For example, latent imaging unit 204 uses a black colored liquid developer material while units 206, 208, and 210 use yellow, magenta and cyan colored liquid developer materials respectively. In as much as units 204, 206, 208 and 210 are similar, only unit 210 will be described here in detail.

At unit 210, a drum 212 having a photoconductive surface 213 deposited on a conductive substrate rotates in the direction of arrow 214. Preferably, the photoconductive surface 213 has uncharged, first potential P1, and is made from a selenium alloy with the conductive substrate being made from an electrically grounded aluminum alloy. Other suitable photoconductive surfaces and conductive substrates may also be employed. Drum 212 rotates in the direction of arrow 214 to advance successive portions of the photoconductive surface through the various processing stations disposed about its path of movement thereof.

Initially, a portion of the photoconductive surface of drum 212 passes beneath a corona generating device 216. Corona generating device 216 charges the photoconductive surface of drum 212 to a relatively high, substantially uniform third electrical potential P3.

Next, the charged portion of the photoconductive surface is advanced through imaging station. At the imaging station, an imaging unit, indicated generally by the reference numeral 218, records an electrostatic latent image on the photoconductive surface of drum 212. Imaging unit 218, for example, includes a raster output scanner. The raster output scanner lays out the electrostatic latent image in a series of horizontal scan lines with each line having a specified number of pixels per inch. Preferably, the raster output scanner employs a laser which generates a beam of light rays that are modulated by rotating polygon mirror blocks or solid state image modulator bars. Alternatively, the raster output scanner may use light emitting diode array write bars. In this way, an electrostatic latent image is recorded on the photoconductive surface of drum 212.

In accordance with the present invention, the drum 212 of each imaging unit 204, 206, 208 and 210 forms a nip 220 with the transfer belt 202. As shown, the multicolor liquid apparatus 200 includes a device 230 (to be described below FIG. 6) for introducing the various colors of liquid toner 132 that is charged to a potential P4 or P5 as above, into the process nip 220 of each imaging unit. The device 230, for example, can be a liquid extruder as disclosed in U.S. Pat. No. 5,355,201, relevant parts of which are incorporated here by reference.

Figure 6:
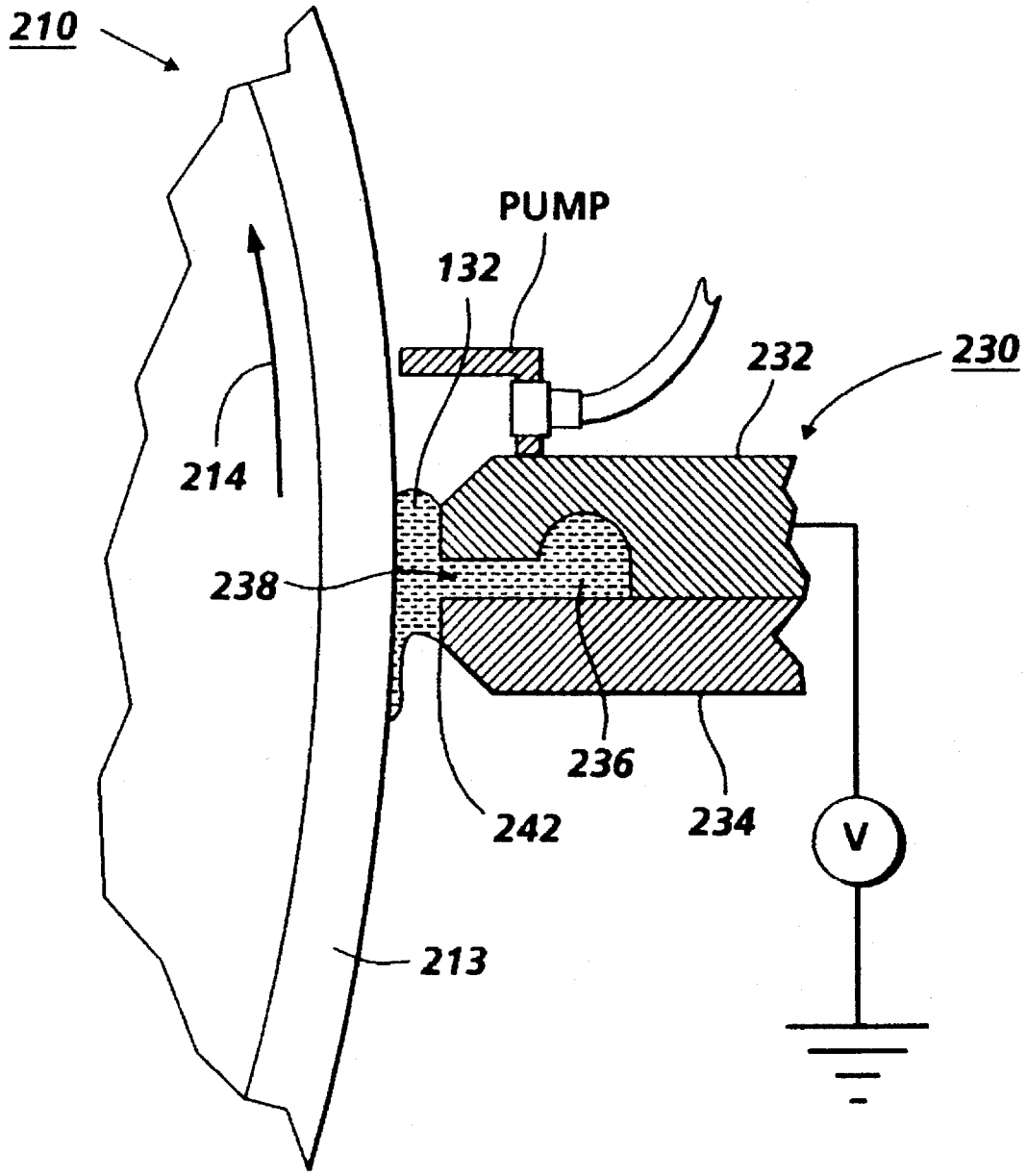
FIG. 6 is an illustration, partially in section, of a liquid toner introduction device for use with the apparatus of the present invention.

Referring briefly to FIG. 6, the liquid extruder 230 includes a first member 232 and a second member 234. An open-ended distribution channel 236 is formed in first member 232. Another distribution channel 238 extends in a direction substantially transverse to channel 236 which is located along the longitudinal axis of the rotatable drum 212. A first portion of the distribution channel 236 is connected to a supply of liquid developer material. A plurality of substantially equally spaced distribution channels 238 intersect with branches of channel 236. Distribution channels 238 receive liquid developer material from channel 236 and guide the liquid developer material to lip 242. The angle of ink distribution to channel 238 ensure that the liquid developer material coats the lip 242 with a film having a straight leading and trailing edge. The angle of the incline of the channel and the cross-sectional diameter ensures substantially uniform distribution of liquid developer material along the lip 242. Lip 242 is a surface of second member 234 which is substantially parallel to the longitudinal axis of drum 212 and defines a gap therebetween. The gap between lip 242 and drum 212 is less than the gap between the surface of first member 232 and drum 212. Lip 242 is used to apply liquid developer material of a substantially uniform thickness to the entire image frame including image and background areas of the latent image recorded on photoconductive surface 213 of drum 212. A metering pump is used to pump a requisite amount of liquid developer material for each electrostatic latent image from the supply of liquid developer material to liquid extruder 230.

As such, the device 230 is a source of charged liquid toner or ink, just as was the source 134 FIG. 2. In a CAD process, the charged liquid toner 132 will have a potential P5 and a polarity that are relatively the same as those of the first, uncharged, electrical potential P1 of surface 213 of drum 212. As such, it is relatively opposite to the third, charged electrical potential P3 of surface 213. The device 230 thus applies a uniform coating of liquid toner onto the entire imaged frame of surface 213, at a point upstream of the process nip 220, when considered relative to movement of the drum 212. The layer of charged liquid toner is brought into the nip 220 on the surface of drum 212, where it is sandwiched according to the present invention as described above between the drum 212 and the surface transfer belt 202, and is moved through the process nip 220, in the presence of electrical fields set up due to the various electrical potentials P1 to P4 or P5.

Referring again to FIG. 5, simultaneous development and transfer of toner image areas and background areas will occur within the nip 220 of imaging unit 210. Accordingly, segmented portions of cyan color liquid toner, in the image areas of the latent image, will each comprise a first layer SL of toner solids that is in contact with the transfer belt 202, and a separate second layer LL, mainly of clear carrier liquid that is in contact with the charge bearing surface 213 of drum 212. On the other hand, segmented portions of cyan liquid toner in the background areas of the latent image will each comprise a separate second layer LL of mainly clear carrier liquid that is in contact with the transfer belt 202, and a first layer SL of toner solids in contact with charge bearing surface 213.

Upon separation of the surface 213 of drum 212 from the surface of the transfer belt 202 at an exit point of the nip 220, each of the segmented portions of sandwiched cyan liquid toner (comprising a solids layer SL, and a liquid layer LL) will "split" at the liquid layer LL thereof from the surface contacting such liquid layer LL. As such, desired cyan color toner image areas each having a toner solids layer SL contacting the surface of the transfer belt 202 and essentially clear liquid layer LL contacting the surface 213, will split at the surface 213 of drum 212. Such splitting leaves essentially only clear liquid layers on the surface 213 in such areas. The toner solids layers SL thereof which make up the desired toner image, will thus separate from the surface 213, and remain on the transfer belt 202. This in effect has been achieved within the nip 220 in a simultaneous develop-and-transfer manner.

On the other hand, the split of the solids and liquid layers in the background areas of the latent image will be quite opposite to the split in the image areas as described above. As such, the splits in the background areas will occur at the clear liquid lyers LL on the transfer belt 202, thus leaving essentially clear liquid on the belt 202 in these areas. The toner solids layer SL thereof will thus remain as a cyan color toner pattern on the surface 213 of drum 212 for subsequent removal by a cleaning device 250.

In accordance with the multicolor embodiment of the present invention, the extruder device 230 of the imaging unit 210 thus uses charged cyan colored liquid developer material, and a cyan toner image is simultaneously developed and transferred onto the belt 202. Latent imaging units 204, 206, and 208 similarly will use charged black, yellow, and magenta colored liquid developer materials, respectively. Generally, the amount of liquid carrier remaining on the liquid toner image on the transfer belt 202 may be more than is desirable for subsequent immediate operations. As such, a roller 252, whose surface moves in a direction opposite to the direction of movement of the transfer belt 202, and that is spaced from the surface of belt 202, may be provided for shearing excessive liquid from the developed image without disturbing the image.

After the developed cyan liquid toner image is simultaneously developed and transferred to continuous transfer belt 202 at the imaging unit 210 as above, continuous transfer belt 202 moves such image to the next imaging unit 208. In general, at the next imaging unit, a liquid toner image of a different color is similarly formed according to the present invention (and in superimposed registration as is well known) onto the transfer belt 202. Accordingly, a magenta liquid toner image is formed on the belt 202 at imaging unit 208 and in superimposed registration with the cyan liquid toner image previously formed thereon. Next, a yellow liquid image is similarly formed at imaging unit 206, and finally, the black liquid toner image is similarly formed at imaging unit 204.

After all of the liquid images have been formed into a multicolor liquid toner image on continuous transfer belt 202 as above, in accordance with the method of the present invention, the multicolor liquid toner image is subsequently transferred at a transfer nip 260 to a sheet of support material, e.g. a sheet of copy paper 154. As shown, transfer nip 260 is formed in part by the continuous transfer belt 202 and by a back up roller 262. As further illustrated, the transfer nip 260 may include a heating device 160 for simultaneously heating and fixing the transferred liquid toner image onto the copy sheet 154. After such fixing or fusing, the copy sheet 154 is advanced to catch tray 266 for subsequent removal from the printing machine by the operator.

Residual liquid developer material remaining or adhering to the continuous transfer belt 202 after transfer is removed for example at a cleaning station 270. Cleaning station 270 may includes a cleaning roller, formed of any appropriate synthetic resin driven in a direction opposite to the direction of movement of continuous transfer belt 202 so as to scrub the surface thereof clean. To assist in this action, liquid carrier may be fed through a pipe onto the surface of the cleaning roller. A wiper blade may also be used to complete the cleaning of the surface of belt 202 in preparation for receiving another multicolor as above.

As can be seen, a method and apparatus have been disclosed for simultaneously developing and transferring liquid toner images to an intermediate receiver member. This is accomplished by sandwiching liquid ink or toner in a nip formed by a photoreceptor carrying the electrostatic latent form of the image and by a synchronous speed conductive or dielectric overcoated conductor, intermediate belt which is biased at a voltage intermediate between the image potential and the background voltage of the photoreceptor. With appropriate biasing and image potential, it is possible to so form positive or negative images (using positive or negatively charged liquid toners). Preferably, the images must be so formed on the belt using a convex shaped photoreceptor. The toner image formed on the belt would require blotting and for color products the process would have to be repeated several times.

The process of the present invention can be referred to as a transdevelopment process, since it involves a simultaneous development and transfer that results in toner images being created directly on an intermediate member, not on the photoreceptor with subsequent transfer as is conventional. Such simultaneous development and transfer is enabled by creation of a development nip consisting of a photoreceptor and the transfer belt moving at the same speed and in the same direction. Liquid toner at approximately 2%–25% solids is introduced into the nip. The photoreceptor normally biased at a first potential, is charged to a voltage or potential P3 (V-high), and is discharged in image areas to the first potential voltage P1 (V-low). The transfer belt which can be conductive or dielectric coated is at another potential or voltage P2 (V-mid) so that P2 lies between P3 (V-high) and P1 (V-low). The electric fields as such in conjunction with the charge on the toner, will force the charged toner in the process nip against the transfer belt in image areas. On the other hand, it will force the charged toner against the photoreceptor in background areas. In the nip, the sandwiched toner forms solids layers of more concentrated toner on top or below layers of clear carrier liquid. At the exit of the nip, the sandwiched toner will split in the regions of lowest viscosity, i.e., in the layers of clear carrier liquid. In multicolor image on image processing, a first toner image is thus produced directly on the transfer belt, and can then be conditioned on the belt before the next and subsequent toner images are similarly transdeveloped onto the first toner image.

The advantages of the transdevelopment process of the present invention include the fact that with a long process nip created by a large wrap of the belt over the photoreceptor (drum or belt) high viscosity inks can be transdeveloped directly onto the belt. Another advantage is that higher solids concentration inks can be used since toner will only be required to migrate a very short distance in a direction normal to the photoreceptor and belt surfaces. The ink layer will move through the nip with uniform velocity equal to the photoreceptor and belt velocity. The gap in the nip can be controlled by proper tension on the belt.

The development process of the present invention is similar to that observed in parallel plate electrode development, including some ink visualization cells. In parallel plate electrode development experiments, highly concentrated toner layers were created by applied electric fields. Areas of clear carrier fluid resulting from toner migration were observed. A further important observation was that if the electrodes were separated apart while maintaining an applied voltage thereon, the sandwiched toner split occurred in the clear liquid layers leaving one electrode with the toner layer and the other with half of the clear liquid layer.

This same film splitting effect will occur at the exit of the transdevelopment nip according to the present invention, thus leaving toner images with clean background on the transfer belt. A further advantage is that since shearing forces are small in a system with uniform velocity, disturbance of the toner layer due to high shearing forces will not occur in a transdevelopment according to the present invention.

While this invention has been described in conjunction with a specific embodiment thereof, it is evident that many alternatives, modifications, and variations will be apparent to those skilled in the art. Accordingly, it is intended to embrace all such alternatives, modifications and variations that fall within the spirit and broad scope of the appended claims.

What is claimed is:

1. An apparatus for simultaneously developing and transferring a liquid toner image, the apparatus comprising:

(a) a movable photoreceptive member having a charge bearing surface biased to an uncharged, first electrical potential;

(b) a movable flexible intermediate transfer member biased to a second electrical potential, said flexible intermediate transfer member forming a long concave simultaneous development and transfer process nip with said charge bearing surface, and said flexible intermediate transfer member being spaced a distance of 15 to 50 microns within said process nip from said charge bearing surface;

(c) means for forming a latent image electrostatically on said charge bearing surface, said latent image forming means including a charging device for uniformly placing a layer of charge on said charge bearing surface, and said formed latent image including image areas each having a third electrical potential, and background areas each having said uncharged, first electrical potential of said charge bearing surface; and (d) means for introducing charged liquid toner consisting of toner solids and a carrier liquid into said process nip, said charged liquid toner having a fourth electrical potential, and said charged liquid toner being sandwiched, within an electrical field formed within said nip by said first, said second, and said third electrical potentials, and between said charge bearing surface and said intermediate transfer member, so as to simultaneously develop and transfer a toner image of image areas of said latent image onto said intermediate transfer member, and a toner pattern of said background areas of said latent image onto said charge bearing surface.

2. The apparatus of claim 1, wherein said charge bearing surface of said photoreceptor has a convex path within said process nip.

3. The apparatus of claim 2, wherein at least one of said photoreceptor and said intermediate transfer member is flexible.

4. The apparatus of claim 3 wherein said second velocity is equal to said first velocity for synchronous movement of said charge bearing surface and said intermediate transfer member through said process nip.

5. The apparatus of claim 1 including a first moving means for moving said charge bearing surface of said photoreceptor in a first direction and at a first velocity through said process nip.

6. The apparatus of claim 5 including a second moving means for moving said intermediate transfer member in said first direction and at a second velocity through said process nip.

7. The apparatus of claim 1 wherein said intermediate transfer member is electrically conductive.

8. The apparatus of claim 7 wherein said conductive intermediate transfer member comprises a dielectric substrate having an electrically conductive overcoating.

9. The apparatus of claim 7 wherein said second electrical potential of said intermediate transfer member falls within a range between said first and said third electrical potentials of said image areas and said background areas respectively of said latent image.

10. The apparatus of claim 1, wherein said intermediate transfer member and said photoreceptor are mounted and moved so as to have the same direction at an entrance of said process nip, and substantially opposite directions at an exit of said process nip.

11. The apparatus of claim 1, wherein said means for forming a latent image electrostatically includes discharging means for imagewise discharging portions of said uniformly charged charge bearing surface.

12. The apparatus of claim 11, wherein said imagewise discharged portions of said charge bearing surface comprise said image areas of said latent image.

13. The apparatus of claim 11, wherein said imagewise discharged portions of said charge bearing surface comprise said background areas of said latent image.

14. The apparatus of claim 13, wherein said charged liquid toner has a polarity relatively the same as a polarity of said third electrical potential of said background areas.

15. The apparatus of claim 13, wherein said charged liquid toner has a polarity relatively opposite to a polarity of said second electrical potential of said image areas.

16. The apparatus of claim 1, wherein said means for introducing charged liquid toner into said process nip includes means for applying a uniform coating of charged liquid toner onto a portion of the surface of said intermediate transfer member and at a point upstream of said process nip, relative to movement of said intermediate transfer member.

17. The apparatus of claim 16, wherein said liquid toner comprises a carrier liquid and a 2%–25% toner solids content by volume.

18. The apparatus of claim 17, wherein said liquid toner sandwiched in said process nip within said electrical field comprises segmented portions, each portion of said segmented portions including a first layer of toner solids and a separate second layer of carrier liquid.

19. The apparatus of claim 18, wherein segmented portions of liquid toner within said nip corresponding to said image areas of said latent image being developed and transferred simultaneously comprise said first layer of toner solids contacting said intermediate transfer member and said separate second layer of carrier liquid contacting said charge bearing surface.

20. The apparatus of claim 18, wherein segmented portions of liquid toner within said nip corresponding to said background areas of said latent image being developed and transferred simultaneously comprise said separate second layer of carrier liquid contacting said intermediate transfer member and said first layer of toner solids contacting said charge bearing surface.

21. The apparatus of claim 18, wherein upon separation of said process nip at an exit point of said nip, said separate second layers of carrier liquid of each of said segmented portions of said liquid toner sandwiched therein separate from said intermediate transfer member and from said charge bearing surface.

22. The apparatus of claim 1, wherein said charged liquid toner sandwiched within said process nip in said electrical field forms in image areas of said latent image, a toner solids layer on said intermediate transfer member, and a carrier liquid layer on said same image areas on said charge bearing surface.

23. The apparatus of claim 1, wherein said charged liquid toner sandwiched within said process nip in said electrical field forms in background areas of said latent image, a toner solids layer on said charge bearing surface, and a carrier liquid layer in said same background areas on said intermediate transfer member.

24. The apparatus of claim 23, wherein said toner solids pattern formed on said charge bearing surface in said background areas remains electrostatically attached thereto downstream of an exit point of said process nip, relative to movement of said charge bearing surface.

25. The apparatus of claim 24, including a cleaning device mounted downstream of said exit point of said process nip for cleaning and removing liquid toner from said charge bearing surface.

26. The apparatus of claim 1, including means for conditioning said toner image on said intermediate transfer member, said conditioning means including a heating device mounted downstream of an exit point of said process nip.

27. The apparatus of claim 1, including a transfer nip formed in part by said intermediate transfer member for transferring said liquid toner image from said intermediate transfer member onto a copy sheet.

28. The apparatus of claim 27, wherein said transfer nip includes heating means therein for simultaneously heating and fixing said liquid toner image onto said copy sheet.

29. The apparatus of claim 1 wherein said process nip has a curvature and said intermediate transfer member has a concave path through said curvature of said nip.

30. An apparatus for simultaneously developing and transferring a liquid toner image, the apparatus comprising:

(a) a movable imaging member including a charge bearing surface;

(b) means for applying a uniform layer of charge on said charge bearing surface, said layer of charge having a first electrical potential;

(c) means for imagewise dissipating charge from selected portions on said charge portions to form a latent image electrostatically on said charge bearing surface, said dissipated portions having a second electrical potential;

(d) a movable flexible intermediate transfer member forming a long concave simultaneous development and transfer process nip with said movable imaging member, said intermediate transfer member being biased to a third electrical potential; and said flexible intermediate transfer member being spaced a distance of about 15 to 50 microns from said charge bearing surface within said process nip.

(e) means for introducing charged liquid toner containing toner solids and carrier liquid into said process nip, said charged liquid toner having a forth potential; and (f) means for moving said movable imaging member and said movable flexible intermediate transfer member through said process nip, said imaging member and said intermediate transfer member sandwiching a layer of liquid toner through said process nip, and said sandwiched liquid toner simultaneously developing both image areas and background areas of said latent image with toner solid patterns and transferring toner solids patterns of image areas onto said intermediate transfer member, and toner solid patterns of background areas onto said charge bearing surface under an electric field created within said process nip by said first, second, third and fourth electrical potentials.

31. A multicolor liquid printing apparatus comprising:

(a) a main assembly including a movable flexible intermediate transfer member, biased to a first electrical potential, for receiving toner images, and means for moving said flexible intermediate transfer member along a path of movement at a first velocity;

(b) a plurality of latent image forming units mounted along a path of movement of said intermediate transfer member, each latent image forming unit including:

(i) a movable photoreceptor including a charge bearing surface having an uncharged, second electrical potential, said charge bearing surface forming a long concave simultaneous development and transfer process nip with said intermediate transfer member and being spaced a distance of 15 to 50 microns from said intermediate transfer member within said process nip.

(ii) means for applying a uniform layer of charge having a third electrical potential onto said charge bearing surface;

(iii) means for imagewise dissipating charge from selected portions of said uniformly charged surface to form a latent image electrostatically on said charge bearing surface, said selected charge dissipated portions having said uncharged, second electrical potential; and (c) means for introducing charged liquid toner containing carrier liquid and charged toner solids of a different color into each process nip formed by each photoreceptor of said plurality of latent image forming units, said charged toner solids having a fourth electrical potential, so as to simultaneously develop and transfer, within each said process nip, a toner image of image areas of said latent image onto said intermediate transfer member, and a toner pattern of background areas of said latent image onto each said photoreceptor of each of said plurality of latent image forming units.

32. The multicolor apparatus of claim 31, wherein said means for introducing charged liquid toner into each said process nip includes a liquid toner applying device for coating, at a point upstream of each said process nip, the image areas and background areas of each latent image on each photoreceptor with liquid toner.

* * * * *